US005309144A

United States Patent [19]

Lacombe et al.

[11] Patent Number: 5,309,144

[45] Date of Patent: May 3, 1994

[54] PROXIMITY SENSING SECURITY SYSTEM

[76] Inventors: David K. Lacombe, 11917 Marbel St., Downey, Calif. 90242; George J. Seelman, 5116 Sereno Dr., Apt. A, Temple City, Calif. 91780; Michael C. Scofield, 151 W. Naomi Ave., Arcadia, Calif. 91007

[21] Appl. No.: 640,926

[22] Filed: Jan. 14, 1991

Related U.S. Application Data

[63] Continuation-in-part of Ser. No. 510,933, Apr. 19, 1990, abandoned.

[51] Int. Cl.[5] ..... G08B 1/08

[52] U.S. Cl. ..... 340/539; 340/502; 340/531

[58] Field of Search ..... 340/539, 531, 502, 552, 340/561

[56] References Cited

U.S. PATENT DOCUMENTS 3,732,555 5/1973 Strenglein ..... 340/426
4,435,699 3/1984 Tacussel ..... 340/539

*Primary Examiner*—Donnie L. Crosland

[57] ABSTRACT

A security system uses a base unit and a portable transceiver which cooperate to provide automatic monitoring of a secure perimeter. An intrusion sensor is employed to activate a transmitter for emitting a selected frequency wave energy challenge transmission upon the detection of an intruder either outside the perimeter or entering the perimeter. If the intruder has the portable transceiver present to receive the challenge transmission, it automatically emits a responsive wave energy signal as an acknowledgment. A base unit receiver detects the acknowledgment signal and prohibits alarm action. If no acknowledgment signal is received, then either a warning or an alarm is triggered at the base unit. The system does not require manual control. The several distinct wave energy signals can be chosen from among various available radio frequency electromagnetic, and audible or ultrasonic acoustic, waves. An advantage of making one of the communication links by acoustic transmission is that the system disarms itself automatically only when the portable transceiver is within a precisely defined distance of the base unit.

11 Claims, 7 Drawing Sheets

PROXIMITY SENSING SECURITY SYSTEM

This application is a continuation-in-part of parent application Ser. No. 07/510,933, filing date Apr. 19, 1990, abandoned.

BACKGROUND OF THE INVENTION AND DESCRIPTION OF THE PRIOR ART

The invention relates to electronic security systems and more particularly to systems that use a remote electronic unlocking device known as a proximity key. Pertinent to the invention are several prior art devices and systems which teach electronic alarm apparatus for monitoring the presence or absence of objects within a given area by monitoring for a coded radio frequency signal. Such devices may contain a monitor including a logic timing circuit for activating a receiver for receiving the radio frequency signal, a check circuit for comparing the received signal with a stored identification code and an audio logic circuit for providing audio and visual indications upon failure of receiving a given number of consecutive transmissions from a given transmitter. The prior art describes an electronic lock actuated by an electronic key. The key comprises a plurality of different resistive elements and a signal generator having a plurality of different timing periods. The key further has a signal transmitter. The electronic lock means comprises a lock and a signal receiver. The lock further has a comparator which includes a plurality of different resistive means. The comparator compares each consecutive timing period with the timing period determined by one of the resistive means. The lock further has an activating element for the lock in the event the consecutive timing periods of said signal match the timing periods determined by the plurality of resistive means. Another prior art device shows an electronic security system and an electronic proximity key for use therein in which a multiple tiered distributed architecture is used to rapidly and flexibly provide ingress and egress through a plurality of electronic locks. In the event of loss of communication with the central processor, the system will continue to provide alarm monitor processing. An improved proximity key for actuating the security system is disclosed which includes coupling coils that are integrally formed as part of the integrated circuit lead frame associated with the coding circuity of such a key. These configurations may be found in the pertinent prior art described in U.S. Pat. No. 4792796, U.S. Pat. No. 4727369, and U.S. Pat. No. 4713660. None of the prior art shows the use of a field disturbance sensor using microwave emission to overcome the FCC prohibition to continual emission in the radio frequency range for devices falling in the class pertinent to the current invention. The prior art does not disclose the use of acoustic wave energy (either audible or ultrasonic) in addition to or in lieu of electromagnetic wave energy The prior art does not disclose the use of acoustic communication links in order to measure the distance between the base unit and the proximity key transceiver, which is available through simple circuitry because of the relatively slow speed of sound, and which is advantageous in preventing the system's disarmament unless the key is precisely within some preselected definition of proximity. The prior art does not disclose the compact, inexpensive to manufacture and highly efficient circuit approach presented in the present invention for achieving the objectives disclosed. Therefore, there exists a need for a proximity sensor which can sense the presence of an intruder without continual radio frequency transmission. The present invention fulfills these needs in a relatively inexpensive fashion and provides further related advantages as described and shown herein.

SUMMARY OF THE INVENTION

The invention is a security system such as would be used, for example, for protecting an automobile parked in a public place. The invention generally consists of a base unit located within the automobile, plus a portable transceiver, known as a proximity key, carried by the owner of the automobile. The advantages of the invention are low cost installation, and most importantly, no action required to arm and disarm the system, i.e., the base unit recognizes the presence of the proximity key through energy wave communication, the proximity key acting to disarm the system automatically. While the energy waves may be either electromagnetic or acoustic, an advantage of the preferred embodiment employing acoustic waves is that distance measurement becomes possible, which provides two important advantages: (1) the user gains confidence in the reliability of the system because it only permits entry when the key is within an exactly predefined distance of the car; and (2) if the key is within a relatively short distance (say on a kitchen table while the car is parked in a nearby driveway), surreptitious entry by an intruder would be possible without the owner's knowledge, unless the definition of proximity used by the system for automatically disarming itself is quite short (say 5 feet), which is not economically practicable using RF transmissions but is possible when one of the communication links consists of an acoustic transmission, as herein disclosed.

In one preferred embodiment a sensor responds to an intrusion by switching the system to an alert state which generates a challenge energy wave transmission. A portable, remote energy wave transceiver, if within reception distance, receives the challenge transmission and responds with an acknowledgment energy wave transmission. An energy wave receiver in the system receives the acknowledgment transmission and responds by switching the system to a standby state. An alarm device responds by taking an alarm action after a fixed time period if the acknowledgment transmission is not received. In a related preferred embodiment the challenge energy wave transmission is emitted continuously. If the acknowledgment transmission has not been received at the time that the intrusion is sensed, then the alarm action is taken. A further preferred embodiment is similar to the first with the addition of a sensor for detecting a potential intruder before actual intrusion occurs. In this embodiment, the additional detector triggers a warning signal to the potential intruder and sets the alarm system in alert mode. If the acknowledgment signal has not been received at the time that the intrusion is detected, then the alarm action is taken.

A third embodiment is designed to take full advantage of a microwave proximity sensing device, usually referred to as a field disturbance sensor. This type of sensor can be used for potential intrusion sensing since motion can be detected up to ten feet from the sensor and is effective through the closed windows of an automobile. It can also sense motion within the protected area. The remote transceiver, designed in a microminiature format, can be carried on a key chain or such. The proximity sensor utilizing 2.45 GHZ field disturbance sensor detunes in the presence of an intruder allowing the detection of the circuit signal amplitude.

Of the alternate perimeter sensing methods possible, the microwave field disturbance sensor has the advantage of operating with ease through the windows of an automobile therefore requiring little, if any, system installation cost for after market automobile applications; using low power, a great advantage for portable, selfcontained applications; and, very importantly, is continuously operable under FCC regulations at field strengths sufficient for monitoring some distance beyond the protected perimeter. The latter feature permits very reliable perimeter sensing and warning before damage to the perimeter can occur. Other common sensors fail to meet the requirements of the current application. Both infrared and ultrasonic detectors must be mounted on the exterior of the automobile or other protected enclosure. This requires additional installation expense and has the drawback of exposing the sensor to damage or tampering.

The miniature proximity key is intended to be carried on a key chain or the like and is powered by a hearing aid battery. To assure long battery life a control circuit turns the receiver on for only one percent of the time. Once an intruder is sensed near the perimeter, the base unit transmits the challenge signal continuously until the intruder departs or the proximity key responds.

The primary object of the current invention is to provide a new and unique security system having broad applicability and advantages over present units which are used for similar purposes. A major object of the invention is to provide a security system which automatically arms and disarms itself without operator attention or control Another object and important feature of the invention is to provide a security system which detects an intruder nearby a protected perimeter and produces a warning before a forced entry can occur Another object is to allow measurement of the distance between the base unit and the proximity key transceiver. Other objects include providing a security system and proximity key which uses relatively little standby energy and which is inexpensive to manufacture and install. Other features and advantages of the present invention will become apparent from the following, more detailed description, taken in conjunction with the accompanying drawings, which illustrate, by way of example, the principles of the invention.

DETAILED DESCRIPTION OF THE PREFERRED EMBODIMENTS

Figure 1:
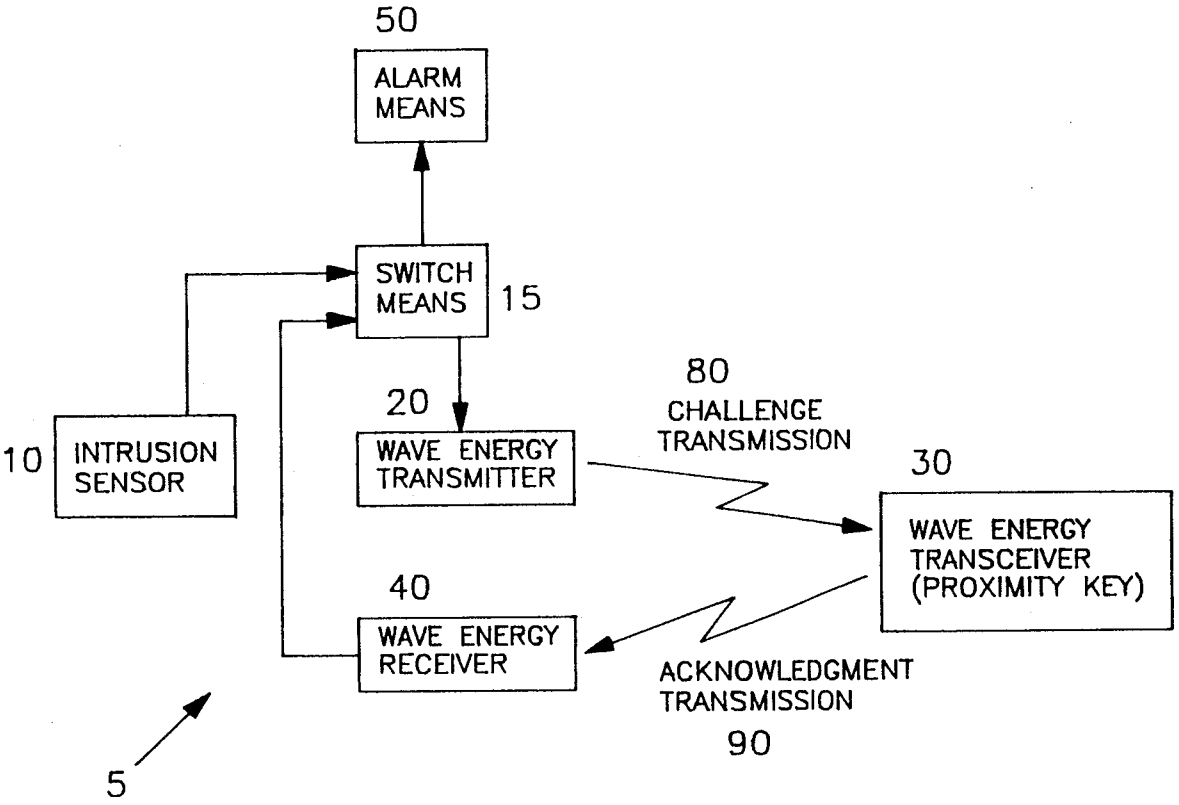
FIG. 1 is a block diagram of the invention as described in one embodiment.

With reference to FIG. 1 there is shown an embodiment of security system 5, comprising intrusion sensor 10 electrically interconnected with switch means 15, in turn electrically interconnected with alarm means 50 and energy wave transmitter 20. Energy wave transceiver 30 is remotely located but interconnected with energy wave wave signals: challenge transmission 80 and acknowledgment transmission 90, respectively.

Figure 2:
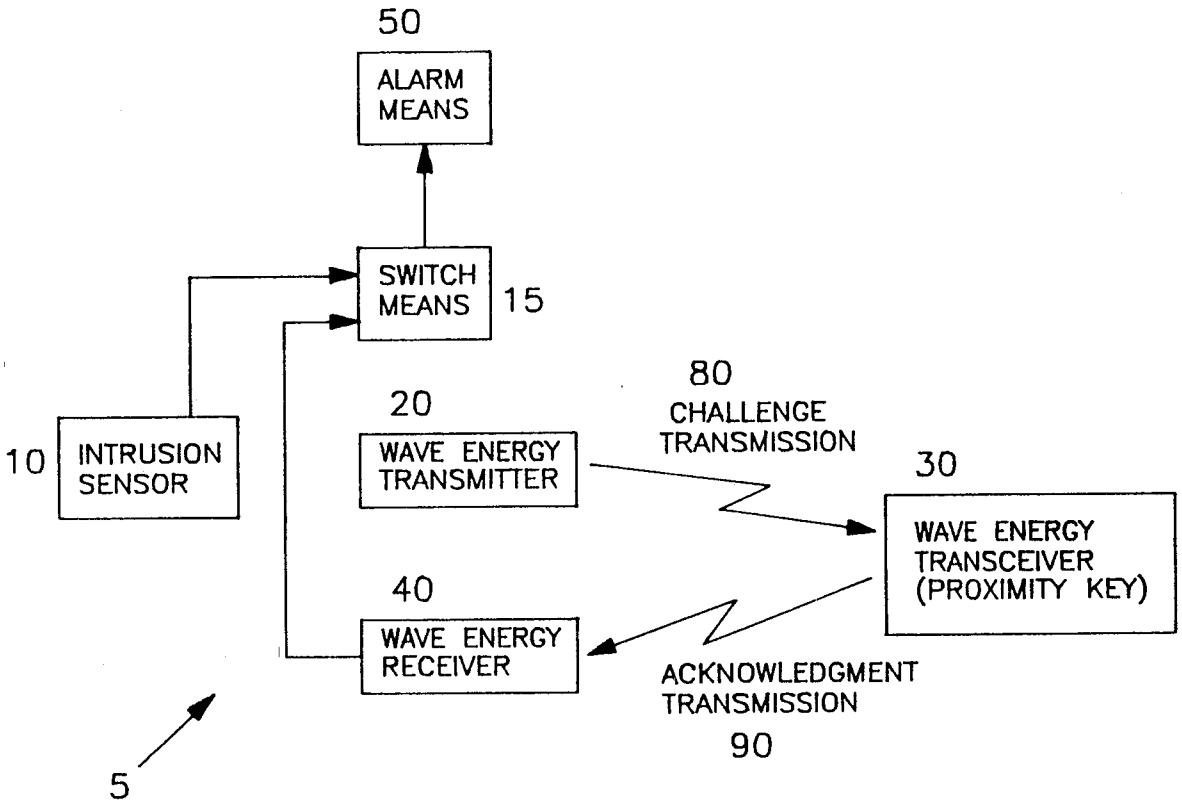
FIG. 2 is a block diagram of the invention as described in an alternate embodiment using a continuous transmitter.

FIG. 2 shows an alternate embodiment which is similar to that of preceding FIG. except switch means 15 is not electrically interconnected with transmitter 20.

Figure 3:
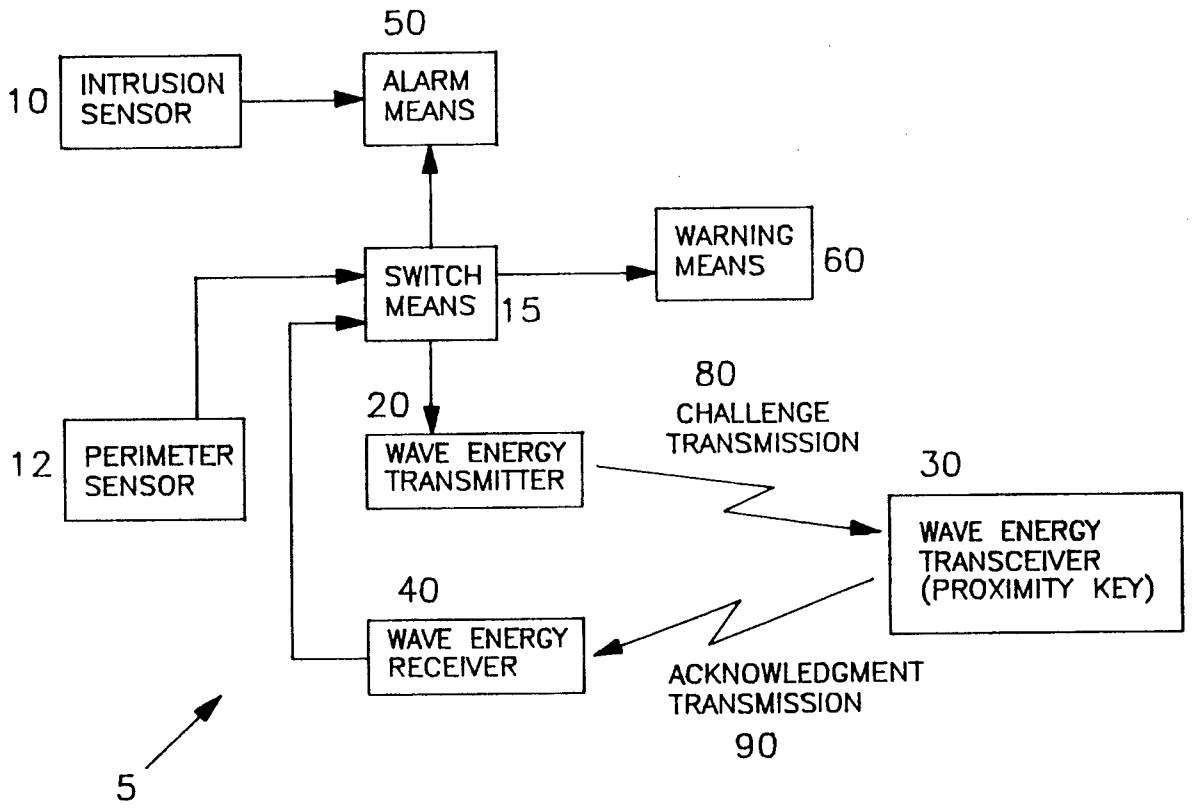
FIG. 3 is a block diagram of the invention as described in a still further embodiment using two sensors; one for intrusion and one for the perimeter.

FIG. 3 shows another alternate embodiment which is similar to that of FIG. 1 except intrusion sensor 10 is electrically interconnected with alarm means 50 instead of switch means 15, perimeter sensor 12 is electrically interconnected with switch means 15 which, in turn, may be electrically interconnected with optional warning means 60.

Figure 4:
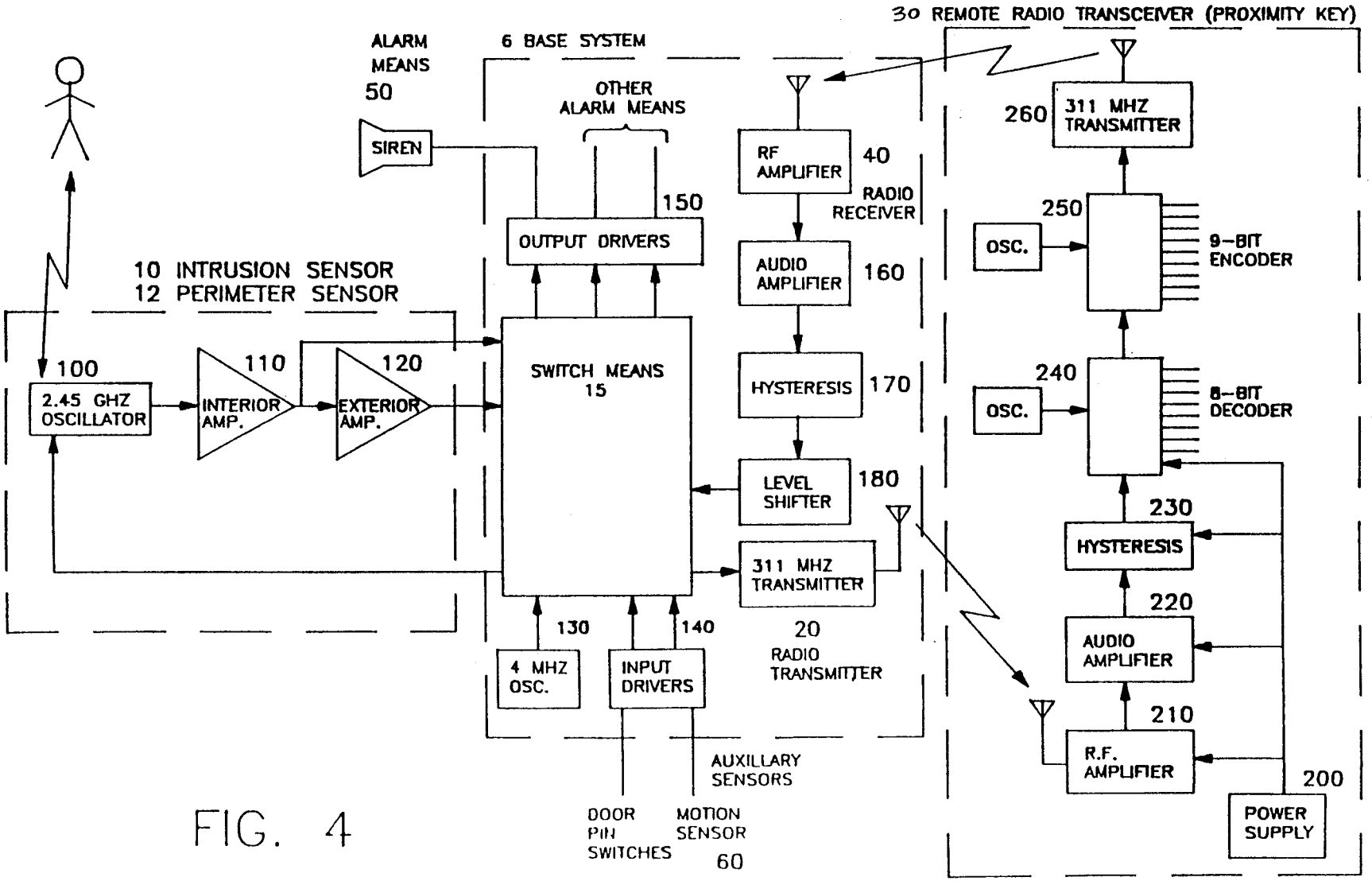
FIG. 4 is a block diagram of the invention showing further details of construction in an embodiment wherein the energy waves consist of RF electromagnetic waves.

FIG. 4 provides details of one preferred embodiment. With reference to FIG. 4 there is shown intrusion sensor 10 and perimeter sensor 12 combined as a dual purpose field disturbance sensor comprised of 2.45 GHZ oscillator 100, interior amplifier 110 and exterior amplifier 120. Sensors 10, 12 are electrically interconnected With base system 6 comprised of switch means 15, radio receiver 40, radio transmitter 20, 4 MHZ oscillator 130, input drivers 140, output drivers 150, alarm means 50, audio amplifier 160, hysteresis stage 170 and level shifter 180. Base system 6 is interconnected by radio transmission with remote radio transceiver 30. Transceiver 30 comprises power supply 200, F.F. amplifier 210, audio amplifier 220, hysteresis stage 230, 8-bit decoder 240, 9-bit encoder 250 and 311 MHZ transmitter 260.

Figure 5:
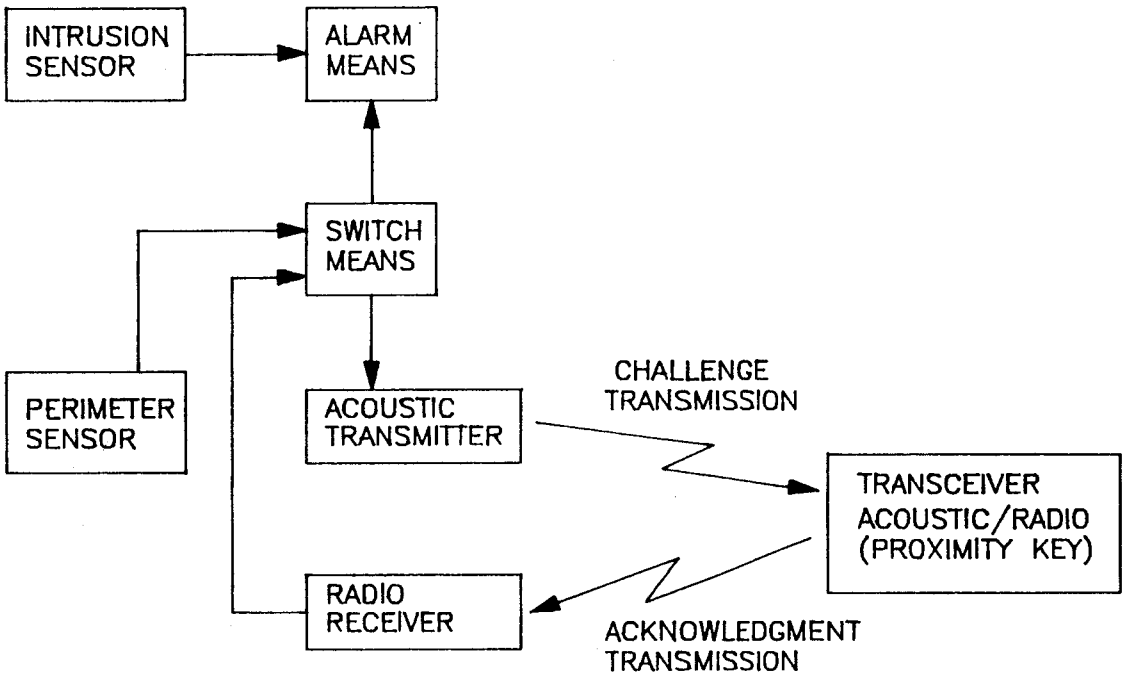
FIG. 5 is a block diagram of the invention in an embodiment wherein the energy waves in the challenge transmission is either combined with optional warning means and consist of audible (4 kHZ) acoustic waves or else consists of essentially inaudible (greater than 16 kHZ) ultrasonic acoustic waves while the acknowledgment transmission consists of RF electromagnetic waves and the proximity key is an acoustic/radio transceiver.

FIG. 5 depicts another preferred embodiment including an acoustic/radio transceiver proximity key and perimeter-triggered acoustic challenge transmission combined with radio acknowledgment transmission. One option includes combination of optional warning means with an audible (e.g. 4 kHZ) acoustic challenge transmission. Alternatively the challenge transmission consists of virtually inaudible (i.e. above 16 kHZ) ultrasonic acoustic waves. Our experience with this embodiment is that such borderline ultrasonic waves to not noticeably disturb humans or animals and are either inaudible or essentially inaudible; in the presently most preferred embodiment we employ 20 kHZ ultrasonic waves.

Figure 6:
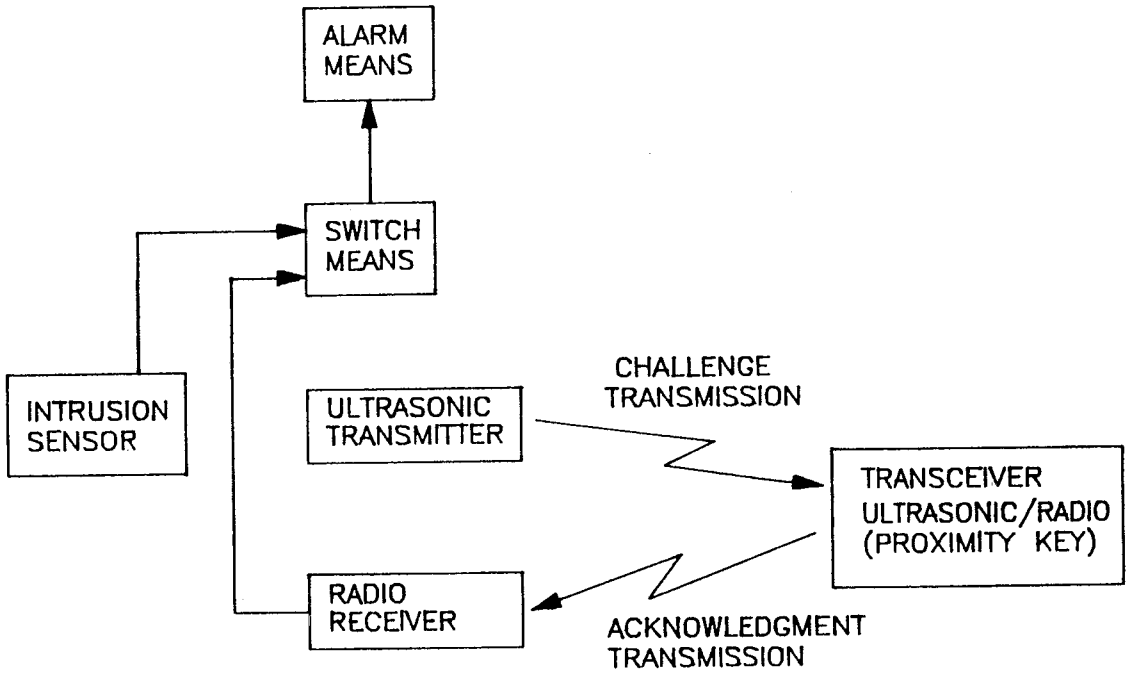
FIG. 6 is a block diagram of the invention in its presently most preferred embodiment wherein the proximity key is an ultrasonic/radio transceiver of the architecture shown in the following FIG. 7 and wherein the challenge transmission consists of continuously emitting ultrasonic (greater than 16 kHZ) acoustic waves chosen as distance measuring means while the acknowledgment transmission consists of RF electromagnetic waves.
Figure 7:
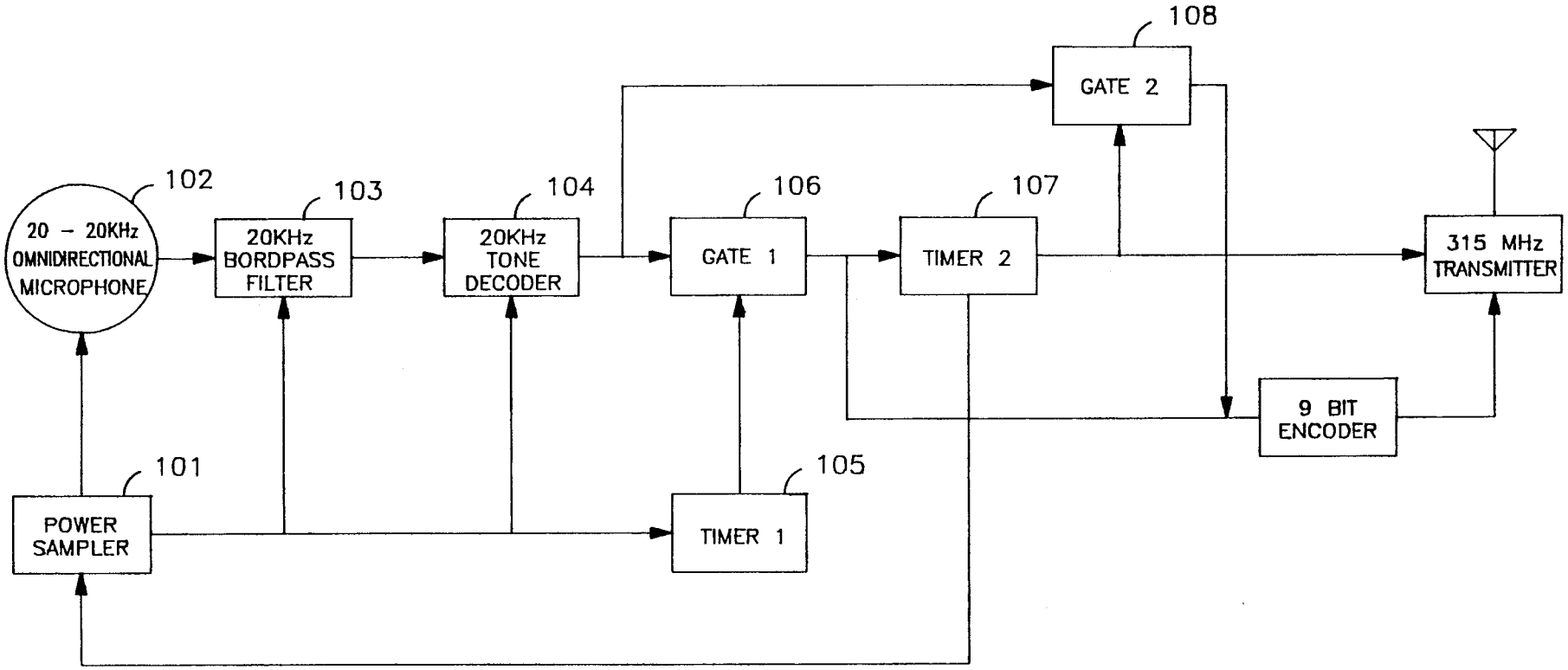
FIG. 7 is a block diagram of the ultrasonic proximity key architecture in the presently most preferred embodiment shown in the previous FIG. 6.

FIG. 6 illustrates the presently most preferred embodiment, in which the challenge transmission consists of 20 kHZ ultrasonic waves which are continuously emitted and chosen to permit measurement of the distance between the base unit and the proximity key ultrasonic/radio transceiver by employment of the known speed of sound as a physical constant embodied in the design via the architecture depicted in FIG. 7.

FIG. 7 illustrates the presently most preferred embodiment of the proximity key ultrasonic/radio transceiver designed so as to include measurement of the distance between the key and the base unit by employment of the speed of sound as a known constant design parameter. Power sampler circuit 101 is connected to 20 Hz −20 kHZ omnidirectional microphone 102, 20 kHZ bandpass filter 103, 20 kHZ tone decoder 104 and first timer 105, which is connected to first gate 106, which is connected to a 9-bit encoder and to second timer 107, which is connected to a 315 MHZ radio transmitter as well as to second gate 108, which is connected to the 9-bit encoder. Tone decoder 104 is also connected to second gate 108. The operation of these elements will be disclosed below.

Security system 5 as shown in FIG. 1 is typically installed within an automobile for intrusion monitoring. Transceiver 30 would be carried upon the person of the automobile owner. Intrusion sensor 10 detects the act of entry such as a door being opened and signals switch means 15 which then assumes an alert state starting a timing device and signaling energy wave transmitter 20 to emit challenge transmission 80. If energy wave transceiver 30 is within range it will receive transmission 80 and respond by transmitting acknowledgment transmission 90. Transmission 90 will be received by energy wave receiver 40 which then signals switch means 15 to go to the standby state. If switch means 15 is still in alert state when the timing device completes its cycle, then switch means 15 signals alarm means 50 to proceed with an alarm action such as starting a siren signal.

The embodiment depicted in FIG. 2 operates in a similar fashion to that of FIG. 1 except that transmitter 20 emits challenge transmission 80 continuously. This is currently in violation of FCC regulation for the service intended for the invention in the case of RF electromagnetic energy wave transmission but would be useful in applications outside of U.S. jurisdiction or if FCC regulations should be modified in the future. When energy wave transceiver 30 is within range of transmitter 20 switch means 15 assumes the standby state. If intrusion sensor 10 detects entry and switch means 15 is not in standby state, then alarm means 50 is activated.

The embodiment depicted in FIG. 3 operates also in a similar fashion to that of FIG. 1 except that a potential intruder is detected before violation of the secured perimeter occurs by perimeter sensor 12. Switch means 15 is then signaled to assume the alert state which causes transmitter 20 to transmit. If transceiver 30 is within range then the sequence of events causes switch means 15 to assume standby state and even if intrusion sensor 10 deteots a perimeter violation alarm means 50 and optional warning means 60 are deactivated. If acknowledgment transmission 90 is not received then transmitter 20 continues to send challenge 80. During this period optional warning means 60 may be activated to alert the potential intruder that he is under surveillance. If intrusion sensor 10 detects a perimeter violation, then alarm means 50 is signaled to activate FIG. 4 shows details of the operation of one preferred embodiment of security system 5 as applied to the protection of an automobile. Combination intrusion sensor 10 and perimeter sensor 12 is activated by 2.45 GHZ oscillator 100. Both interior amplifier 110 and exterior amplifier 120 are sensitive to mass changes in the near surroundings as their electromagnetic fields extend beyond the system cases to include the nearby area. Exterior amplifier 120 is a much more sensitive device so that while amplifier 110 is limited in range to the interior of the automobile, the range of amplifier 120 extends up to approximately 10 feet beyond the body of the automobile. This allows amplifier 120 to act as a perimeter sensor. If a significant sudden change occurs in the mass of the surroundings, as would occur if a human were to enter the immediate area, the output of amplifier 120 would change suddenly due to oscillator detuning, and this change would be detected by switch means 15 which then signals radio transmitter 20 to emit the challenge transmission. Other sensors such as door switches and motion sensors can also signal switch means 15 thereby starting the alert cycle. Remote transceiver 30, if present, receives challenge at R.F. amplifier 210, provides audio amplification through amplifier 220, and stabilizes the signal, removing jitter through hysteresis stage 230. The signal is decoded at decoder 240. Signal coding is required in order to allow several security system 5 to operate close to one another and for security purposes. Encoder 250 is then signaled to provide an acknowledgment via transmitter 260. This signal is processed similarly through receiver 40, amplifier 160, hysteresis stage 170 and level shifter 180. Switch means 15 signals drivers 150 if the appropriate acknowledgement is not received, and alarm means 50 is then activated.

The operation of the preferred embodiment of FIG. 5 is the same as that already explained in connection with FIG. 3, except that here a specific choice of acoustic waves for the challenge transmission 80 has been made. If optional warning means 60 are employed, this may be combined with the choice of audible sonic waves for the challenge transmission 80. The perimeter triggered audible waves thus function to both warn an intruder and to signal the acoustic/radio transceiver proximity key 30. Alternatively essentially inaudible ultrasonic acoustic waves may be employed for the challenge transmission 80. In both cases the distance between the base unit 5 and the proximity key 30 can be measured by using the known speed of sound, and this is an advantage of the embodiment depicted in FIG. 5.

The operation of the presently most preferred embodiment depicted in FIG. 6 is similar to that of either FIG. or FIG. 2 already explained, except that now the challenge transmission 80 is a continuously emitted ultrasonic wave chosen so as to facilitate determination of the distance between the base unit and the proximity key by employment of the architecture depicted in FIG. 7 following. An ultrasonic challenge transmission 80 is emitted continuously when the car is armed. When the key 30 detects the sound waves 80, an encoded RF signal 90 is sent by the key 30 to the base unit 5 to stop the ultrasonic transmission 80. The key 30 is idle for ½ second to ignore any sound waves that may be reflected from walls or buildings. Then an RF pulse 90 is sent by the key 30 to start the ultrasonic transmission 80 again. When the key 30 detects the ultrasonic transmission 80, another RF encoded signal 90 is sent. The time difference between the RF pulse 90 and the second encoded signal 90 is determined by the (essentially constant and known) speed of sound and the distance between the key 30 and the base unit 5.

The presently most preferred embodiment of FIG. 6 is implemented by means of the ultrasonic proximity key architecture depicted in FIG. 7. The operation of this key architecture is as follows:

(a). Power sampler circuit 101 turns on 20—20 kHZ omnidirectional microphone 102, 20 mHZ bandpass filter 103 and the 20 kHZ tone decoder 104 for 15 milliseconds every ½ second. This circuit saves the proximity key battery life.

(b). Microphone 102 detects the 20 kHZ sound waves produced by a piezoelectric tweeter 20. This tweeter 20 is mounted in the automobile engine compartment (and, obviously, must be weatherproofed). The tweeter 20 is continuously transmitting while the car is armed. However, because the transmission frequency is so high, the sound waves cannot be heard by anyone.

(c). Bandpass filter 103 attenuates any ambient noise except the 20 kHZ challenge transmission.

(d). Tone decoder 104 ensures that there will be no false RF transmissions from proximity key 30 by rejecting out of band signals; the decoder 104 will produce an output only if the 20 kHZ signal 80 is acquired for a preset amount of time.

(e). When the power sampler 101 turns on, a first timer 105 begins. This timer 105 allows enough time to permit the microphone 102, the bandpass filter 103, and the tone decoder 104 to power up properly. Timer 105 also allows first gate 106 to produce an output only after the circuits have had time to power up. The function of first gate 106 is to produce an output if the 20 kHZ signal 80 is detected. First timer 105 has a time of 13 milliseconds which is shorter than the power sampler's time of 15 milliseconds. Therefore, there is only 2 milliseconds of time for the 20 kHZ signal 80 to be detected.

(f). If the signal 80 is detected, first gate 106 produces an output that turns on timer 2 and produces a 315 MHZ encoded RF signal to stop the ultrasonic challenge transmission 80. If the signal 80 is not detected, the key 30 will power down until ½ second later.

(g). Second timer 107 does three things:

(i) the timer's output is used to keep the key 30 on longer by sending a signal to the power sampler 101;

(ii) it enables second gate 108; and (iii) it produces an RF pulse 90 when second gate 108 is enabled. Second timer 107 is used to keep second gate 108 off long enough (about ½ second) to allow the ultrasonic sound wave reflections to be ignored. (Recall that according to item f) preceding, challenge transmission 80 was seized; however, sound waves are still reflecting from walls and buildings.) When second gate 108 is enabled, RF pulse 90 is used to turn on the ultrasonic transmission 80. This transmission is the "echo" pulse 80 and is used to measure the distance between the proximity key and the base unit in the car.

(h). Second gate 108 produces an output when the echo pulse 80 is detected. This output produces an encoded RF signal 90. The time difference between the RF pulse 90 of second timer 107 and the RF encoded signal 90 of second gate 108 determines the distance between the key and the base unit. The system is not disarmed unless this distance is below some predetermined proximity definition.

Although but as the description above contains many specificities, these should not be construed as limiting the scope of the invention merely providing illustrations of some of the presently preferred embodiments of this invention.

Thus, the scope of the invention should be determined by the appended claims and their legal equivalents, rather than by the examples given.

We claim:

1. A security system comprising a switch means, said switch means capable of assuming either an alert state or a standby state, at least one intrusion sensor for responding to an intrusion by switching said switch means to an alert state, a wave energy transmitter for responding to said alert state by emitting a challenge transmission, a portable remote transceiver for receiving said challenge transmission and responding with an acknowledgment wave energy transmission, a receiver for receiving said acknowledgment transmission and responding by switching said switch means to a standby state thereby inhibiting said challenge transmission, and an alarm means for producing after a fixed delay time period an alarm action in response to said switch means taking said alert state.

2. A security system comprising a switch means, said switch means capable of assuming either an alert state or a standby state, a wave energy transmitter for emitting a continuous challenge transmission, a portable remote transceiver for receiving said challenge transmission and responding with an acknowledgment wave energy transmission, a receiver for receiving said acknowledgment transmission and responding by switching said switch means to a standby state thereby inhibiting said challenge transmission, at least one intrusion sensor for detecting an intrusion and an alarm means for producing an alarm action in response to said detected intrusion if said switch is not in said standby state.

3. A security system comprising a switch means, said switch means capable of assuming either an alert state or a standby state, a perimeter sensor for responding to a potential intrusion by switching said switch means to an alert state, a wave energy transmitter for responding to said alert state by emitting a challenge transmission, a portable remote transceiver for receiving said challenge transmission and responding with an acknowledgment wave energy transmission, a receiver for receiving said acknowledgment transmission and responding by switching said switch means to a standby state thereby inhibiting said warning device and said challenge, at least one intrusion sensor for detecting an intrusion, and an alarm means for producing an alarm action in response to said intrusion if said switch is in said alert state.

4. The security system of claim 3 wherein said perimeter sensor is a first field disturbance sensor.

5. The security system of claim 3 wherein at least one of said intrusion sensors is a second field disturbance sensor.

6. The security system of claim 4 wherein said perimeter sensor continuously emits microwave energy at a frequency permitted by FCC regulation.

7. The security system of claim 1 or claim 2 or claim 3 wherein said portable remote transceiver is a low power microminiature device.

8. The security system of claim 1 or claim 2 or claim 3 wherein said forms of wave energy selected for said challenge transmission and said acknowledgment transmission are distinct, said challenge transmission consisting of acoustic waves but said acknowledgment transmission consisting of electromagnetic waves.

9. The security system of claim 1 or claim 2 or claim 3 wherein said challenge transmission wave energy consists of perimeter-triggered acoustic waves selected from the group consisting of audible and ultrasonic waves.

10. The security system of claim 1 or claim 2 or claim 3 wherein said challenge transmission consists of continuously emitted ultrasonic acoustic waves.

11. The security system of claim 1 augmented by optional warning means for responding to said alert state by emitting a warning signal, and by providing for said switching to standby state to inhibit said warning means.

* * * * *